US005527058A

United States Patent [19]

Janisch et al.

[11] Patent Number: 5,527,058

[45] Date of Patent: Jun. 18, 1996

[54] FRONT JAW FOR A SAFETY SKI BINDING

[75] Inventors: Andreas Janisch, Oeynhausen; Karl Stritzl, Vienna, both of Austria

[73] Assignee: HTM Sport- und Freizeitgeraete Aktiengesellschaft, Schwechat, Austria

[21] Appl. No.: 325,188

[22] PCT Filed: Dec. 17, 1993

[86] PCT No.: PCT/EP93/03593

§ 371 Date: Oct. 14, 1994

§ 102(e) Date: Oct. 14, 1994

[87] PCT Pub. No.: WO94/19071

PCT Pub. Date: Sep. 1, 1994

[30] Foreign Application Priority Data

Feb. 23, 1993 [AT] Austria ..... 347/93
Jun. 17, 1993 [AT] Austria ..... 1190/93

[51] Int. Cl.[6] ..... A63G 9/10

[52] U.S. Cl. ..... 280/634; 280/623; 280/626

[58] Field of Search ..... 280/623, 629, 280/626, 625, 634, 611

[56] References Cited

U.S. PATENT DOCUMENTS 4,149,124 4/1979 Wittmann et al. ..... 280/634 X
4,979,762 12/1990 Gallet ..... 280/625
5,193,641 3/1993 Stritzl et al. ..... 280/625
5,273,306 12/1993 Wawra ..... 280/634 X
5,310,207 5/1994 Stritzl et al. ..... 280/629
5,333,891 8/1994 Stritzl et al. ..... 280/625
5,380,032 1/1995 Challande et al. ..... 280/634

FOREIGN PATENT DOCUMENTS 0564768 10/1993 European Pat. Off. ..... 280/634

*Primary Examiner*—Christopher P. Ellis
*Attorney, Agent, or Firm*—Flynn, Thiel, Boutell & Tanis

[57] ABSTRACT

A front jaw for a safety ski binding comprising a housing (1) and two two-arm bent levers (*9a, 9b*) which are each pivotal about an essentially vertically oriented axis on a bearing block (6) supported for limited movement in the housing and engage a release plate (25) which is pivotally supported on the housing (1) and is loaded by a release spring (14) through a pull piece (28) with a forwardly directed pulling force, with the pull piece (28) engaging with its front end a spring-receiving means (15) which is movable along a center bolt (16), and the center bolt (16) being supported by means of a bolt head (17) on the front side of the housing (1) and being connected through a thread (18) to a spring-support plate (19) loaded by the release spring (14).

14 Claims, 3 Drawing Sheets

FRONT JAW FOR A SAFETY SKI BINDING

FIELD OF THE INVENTION

The invention relates to a front jaw for a safety ski binding comprising a housing adapted to be fastened onto a ski, and two two-arm bent levers which are each pivotal about an essentially vertically oriented axis on a bearing part supported for limited movement in the housing about an essentially transversely extending axis, with the longer arms of both bent levers, which arms lie to the outside, being designed as sole holders and the shorter arms of both bent levers, which arms lie to the inside, engaging a release plate which is loaded by a release spring through a connecting element with a forwardly directed pulling force, which release spring is housed in the housing, is supported at its front end on a spring-receiving means, and surrounds a centrally oriented bolt.

BACKGROUND OF THE INVENTION

A front jaw of this type, which has become known from EP-A-365 861, has a release plate which is pivotal about a transverse axis extending in the upper or lower housing area. The release spring surrounds the centrally oriented bolt, which acts as a pull rod for the release plate. The front end of the bolt is for this purpose screwed into an adjusting nut, against which is supported the front end of the release spring. This front end of the spring can thus be moved together with the adjusting nut relative to the housing, whereas the rear end of the release spring is supported on a housing-fixed wall.

A similar design is shown in AT-PS 396 337. A front jaw is described in this document in which two bent levers on a common bearing part are each hinged on a respective vertical axis, with this bearing part being supported upwardly and laterally pivotally on the housing. Both bent levers engage a release plate connected to a bolt and which is tensioned forwardly by the release spring through the adjusting screw. The release spring is supported housing-fixed directly in front of the release plate and is supported at its front end through a spring-receiving means guided on the housing on the adjusting screw. The adjusting screw and the bolt connected to the release plate are screwed together by means of a thread, thus creating the desired initial tension of the release spring. A pointer is furthermore mounted on the spring-receiving means to indicate the presetting of the release spring on an indicator which can be viewed through a window.

A disadvantage of the front jaws known from the two above-mentioned documents is that the indicator of the binding adjustment is changed during a stress on the release spring. This means that the indicator changes in an undesired manner already when the skier places the ski shoe into the binding. Furthermore, the housing is not closed off in front because of the support of the release spring and it can happen that the action of the release spring is affected, for example, by dirt, snow or ice.

DE-A 39 00217 discloses a very complicated design in which the bent levers are supported on lateral, two-arm levers. These lateral levers are loaded with pressure by a piston loaded by the release spring. Moreover, the piston is rearwardly extended for a backward release, with a cross-bolt, sitting on the arms of the extension, being guided along a ski-fixed control curve. An axial rod extending through the release spring is supported housing-fixed at its rear end, whereas the front end of the rod is not supported on the front side of the housing. A pointer is in this front jaw connected to the spring-support plate.

It is a purpose of the invention to provide a front jaw in which the above-identified disadvantages are avoided, with the design being mechanically simple and well protected against environmental influences.

SUMMARY OF THE INVENTION

This purpose is attained by means of a front jaw of the above-mentioned type, in which the connecting element is, according to the invention, a pull piece which engages the spring-receiving means at its front end, which spring-receiving means can be moved along the center bolt, with the center bolt being supported by means of a bolt head on the front side of the housing and being connected through a thread to a spring-support plate loaded by the release spring.

The presetting of the release spring and the effect of this release spring on the release plate were mechanically separated by the measures of the invention, thus the indication of the binding adjustment is not changed, not even during stress on the release spring. Furthermore, it is possible to design the housing of the front jaw closed, thus significantly reducing the probability that the function of the front jaw is influenced by snow, ice or dirt. Through the lever system, which is created by the pivotal release plate, a particularly good release behavior during backward or backward twisting falls can be achieved since the occurring friction losses are kept extremely low.

The release plate is in a particularly advantageous embodiment of the invention housed in the lower part of the housing and extends essentially vertically upwardly, with the arms of the bent levers, which arms lie to the inside, engaging in the upper area of this release plate on the front side. Furthermore, the pull piece, which is guided above the release spring to the spring-receiving means, engages the upper end of this release plate. With this a simple and space-saving assembly of the front jaw with a simultaneous lever action becomes possible. Moreover, this special arrangement of the release plate permits a simple construction of the backward release. An advantage of this embodiment is furthermore that the freedom of movement of the pull piece is not influenced by contamination, like snow, ice or dirt, which accumulates in the lower part of the front jaw.

A simple mechanical design is made possible by the pull piece being designed plate-shaped and bent at both ends, with the front bent end being supported between the spring-receiving means and the housing, and the rear bent end being received in a recess provided at the upper end of the release plate.

A pointer is advantageously connected to the spring-support plate, which pointer indicates the set initial tension of the release spring on a housing-fixed indicator. As has already been stated earlier, the position of this pointer with respect to the housing or rather the housing-fixed indicator is advantageously determined by the presetting of the release spring.

Furthermore, a stop in the form of an essentially vertical crosswall can be arranged behind the release plate, with an elastic filler piece, for example of a foam rubber, being inserted between the release plate and this crosswall. The crosswall additionally prevents any type of contamination, mainly snow or ice, from penetrating into the inside of the front jaw. Should nevertheless contamination of any type reach into the front jaw, the elastic filler piece prevents the release mechanism from being influenced or even blocked by such contamination.

Both the backward and also the diagonal release is structurally improved by the release plate having a transversely arranged cam on which acts a lever extension constructed on the bearing part during a pivoting movement of this bearing part against the force of the release spring.

The desire for an inexpensively and simply manufactured front jaw is met in a preferred embodiment of a front jaw of the invention by the bearing part consisting of an upper partial element and a lower partial element, and the partial elements being connected form-lockingly in the state of use, with the bent levers being supported on the lower partial element and the upper partial element having a support surface on its front side, by means of which support surface the bearing part can be supported on the housing.

The part of the bearing part on which the bent levers are supported, and the part which carries a support surface for the backward release, were separated with respect to manufacture with the measures of the invention so that this manufacture can be done particularly inexpensively. In particular, one single lower partial element can be manufactured for all types of bindings in greater masses. The upper partial element can be manufactured of a less expensive material which, in particular with respect to the coloring, can be easily worked.

An advantageous embodiment of the support surface results in the above-discussed exemplary embodiment from a first, essentially vertically oriented partial section, a second, slightly rearwardly inclined partial section lying thereabove and a third, more sharply rearwardly inclined partial section lying thereabove, with the first one of these partial sections transferring through an edge into the second partial section and same through a further edge into the third partial section of the support surface.

It is furthermore advantageous when the upper partial element of the bearing part has a curved bearing surface through which the bearing part is supported in an upward direction on a bearing link provided in the housing.

It is particularly advantageous when this curved bearing surface is constructed near the support surface and, viewed from the side, has a circular section and a straight section which drops off in a rearward direction.

The centerpoint of the circular section of the bearing surface lies advantageously in the direct vicinity of the edge between the first and second partial sections of the support surface, in particular at the same height with this edge.

A simple form-locking connection of the upper and the lower partial element of the bearing part is created through two bolts which extend essentially vertically through the bearing part, with each bent lever being supported on a respective one of these bolts.

The two partial elements of the bearing part consist, for the purpose of a particularly inexpensive manufacture, of different materials, with the upper partial element being manufactured of a plastic and the lower partial element preferably of steel or aluminum die cast metal.

BRIEF DESCRIPTION OF THE DRAWINGS

Further details and advantages of the front jaw of the invention can be taken from the following description, which has been written with reference to the accompanying drawings illustrating one exemplary embodiment of the present invention and in which.

DETAILED DESCRIPTION

Figure 1:
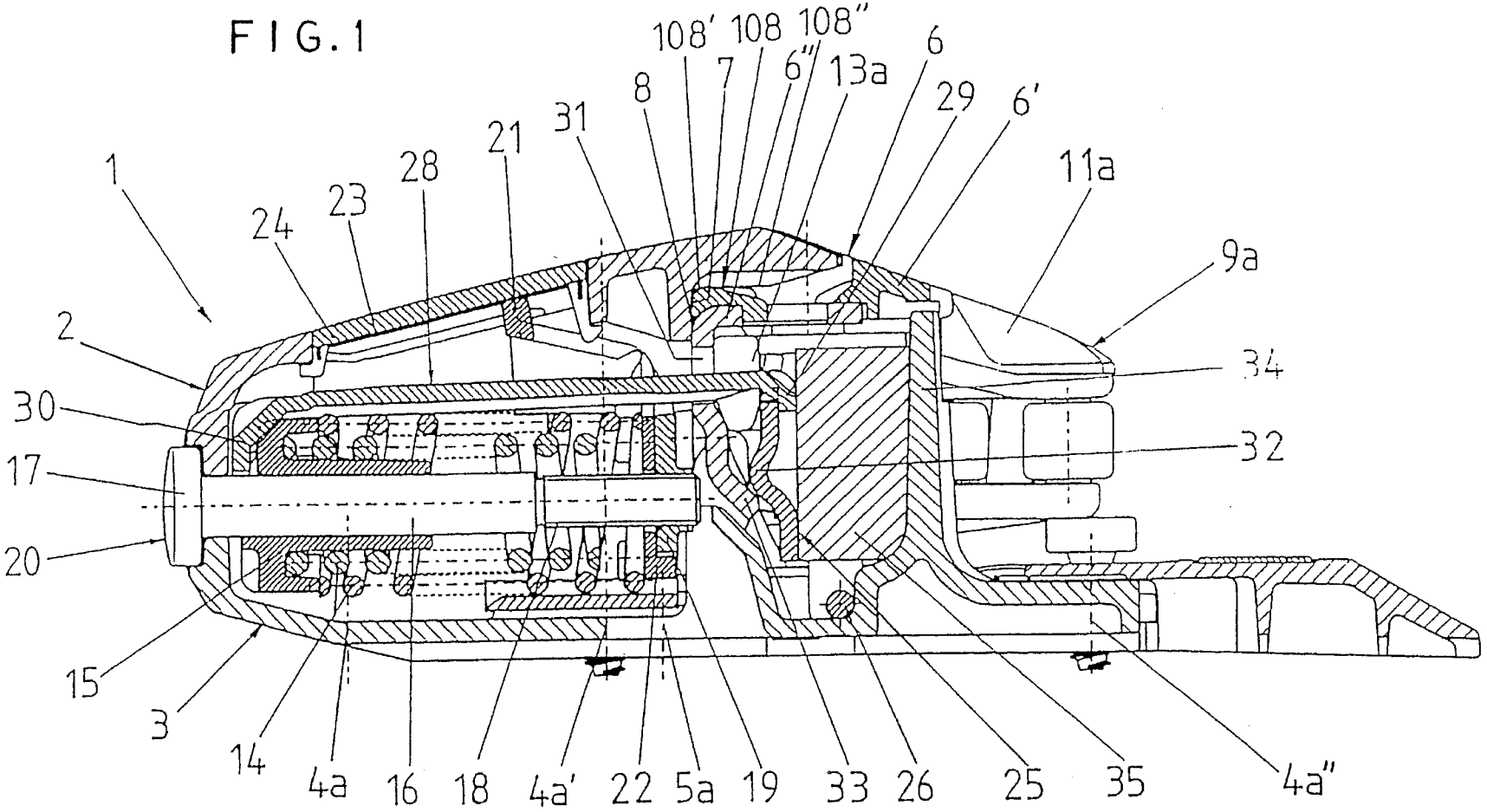
FIG. 1 is a schematic longitudinal central cross-sectional view of a front jaw of the invention.
Figure 2:
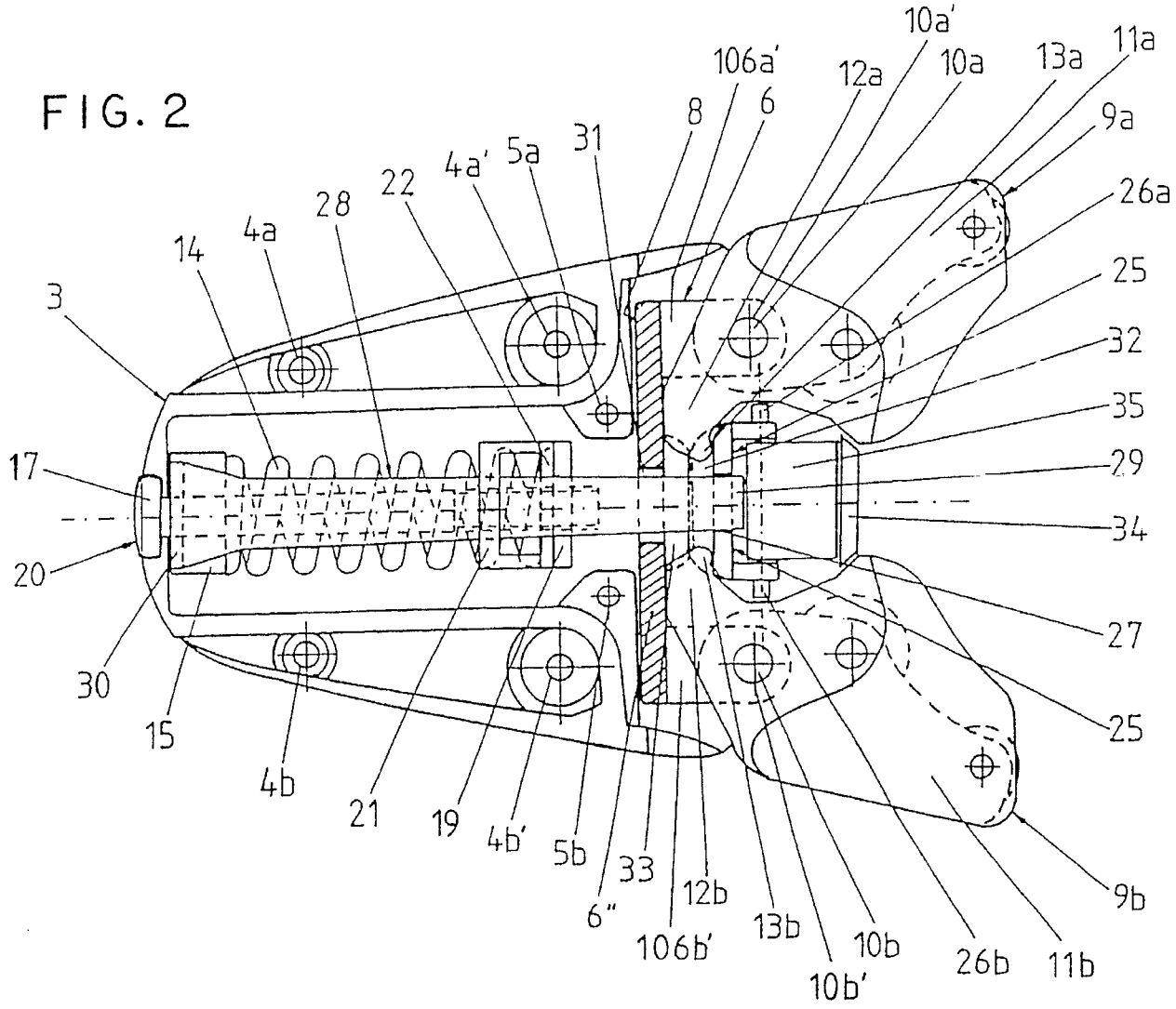
FIG. 2 is a schematic top view of the front jaw according to FIG. 1.

The following description makes reference to FIGS. 1 and 2, in which a front jaw of the invention is illustrated. The front jaw has housing 1 which consists of a lower part 3 and an upper part 2. FIG. 2 does not show the upper part 2 of the housing for reasons of clarity. Bores 4*a*, 4*b*, 4*a'*, 4*b'*, 4*a"*, 4*b"* hold suitable screw bolts which enable a screwing of the front jaw to the ski. Furthermore, the lower part 3 of the housing is screwed to the upper part 2 of the housing, for which purpose two further bores 5*a*, 5*b* are provided in the lower part 3 of the housing. A bearing part 6 is supported for limited movement on a crosswall 8 of the upper part 2 of the housing by means of a support surface 7. Two bent levers 9*a*, 9*b* are each pivotally supported about an essentially vertically oriented axis on the bearing part 6 by means of bolts 10*a*, 10*b*. The exact design of the bearing part 6 and of the support surface 7 will be discussed in greater detail hereinafter with reference to FIG. 3.

The bent levers 9*a*, 9*b* are designed with two arms, with the outer arms of the bent levers 9*a*, 9*b* being constructed as sole holders 11*a*, 11*b* and the shorter arms 12*a*, 12*b* of the bent levers 9*a*, 9*b*, which shorter arms lie to the inside, each being loaded through a cam 13*a*, 13*b* by a release spring 14 of the front jaw with a forwardly directed pulling force. The release spring 14 consists, in the here illustrated exemplary embodiment, of two coaxial coil springs, of which FIG. 2 for reasons of clarity shows only the outer one. This release spring 14 is supported at its front end on a spring-receiving means 15, which is horizontally movable along a bolt 16. The bolt 16 has at one end a bolt head 17 which is recessed into the front side of the housing 1. This bolt has a thread 18 at the other end, which thread is threadedly engaged with a spring-support plate 19. The bolt 16 with the head 17 and the thread 18 forms the adjusting screw 20 of the front jaw, by means of which the initial tension of the release spring 14 is adjusted in a conventional manner. This adjustment of the release spring 14 is indicated on a housing-fixed indicator 23 by means of a pointer 21, which indicator can be viewed through a window 24 in the upper part 2 of the housing. The pointer 21 is fixedly connected to the spring-support plate 19 through a mounting 22. This mounting 22 is, in the here illustrated exemplary embodiment, inserted between the spring-support plate 19 and the release spring 14.

The type of the transfer of force between the release spring and the inner arms 12*a*, 12*b* of the bent levers 9*a*, 9*b* (during a lateral or diagonal load) or rather on the bearing part 6 (during a load in an upward direction or during a diagonal load) will be discussed hereinafter. A central release plate 25 is supported for pivotal movement about a transversely extending axis on the lower part 3 of the housing by means of two axle journals 26 in the area of the support bolts 10*a*, 10*b* for the bent levers 9*a*, 9*b*. The release plate 25 extends essentially vertically upwardly from the support area in the rest position illustrated in FIG. 1. The cams 13*a*, 13*b* on the inner arms 12*a*, 12*b* of the two bent levers 11*a*, 11*b* engage symmetrically with respect to the central longitudinal axis of the front jaw the upper end of this release plate 25. Furthermore, a central recess 27 is provided in the upper end of the release plate 25, into which recess is received a pull piece 28 having a bent end segment 29, which pull piece is also bent over on both sides. This pull piece 28 extends through an opening 31 provided in the bearing part forwardly of and above the release spring 14 to a location where the other bent end 30 of this pull piece 28 engages the horizontally movable spring-receiving means 15 which is loaded by the release spring 14. The pull piece 28 is thus urged forwardly through the spring-receiving means 15 by the release spring 14, thus causing a forwardly directed pulling force to act onto the release plate 25 and onto the inner arms 12*a*, 12*b* of the bent levers 10*a*, 10*b*.

A transversely positioned cam 32 is additionally constructed, approximately at half height, on the release plate 25, which cam operatively engages a lever extension 33 provided on the bearing part 6. At a specific distance behind the release plate there is provided a stop in the form of a crosswall 34 on the lower part 3 of the housing, with an elastically yieldable filler 35, for example of a foam rubber, being inserted in the space between the release plate 25 and this crosswall 34.

Figure 3:
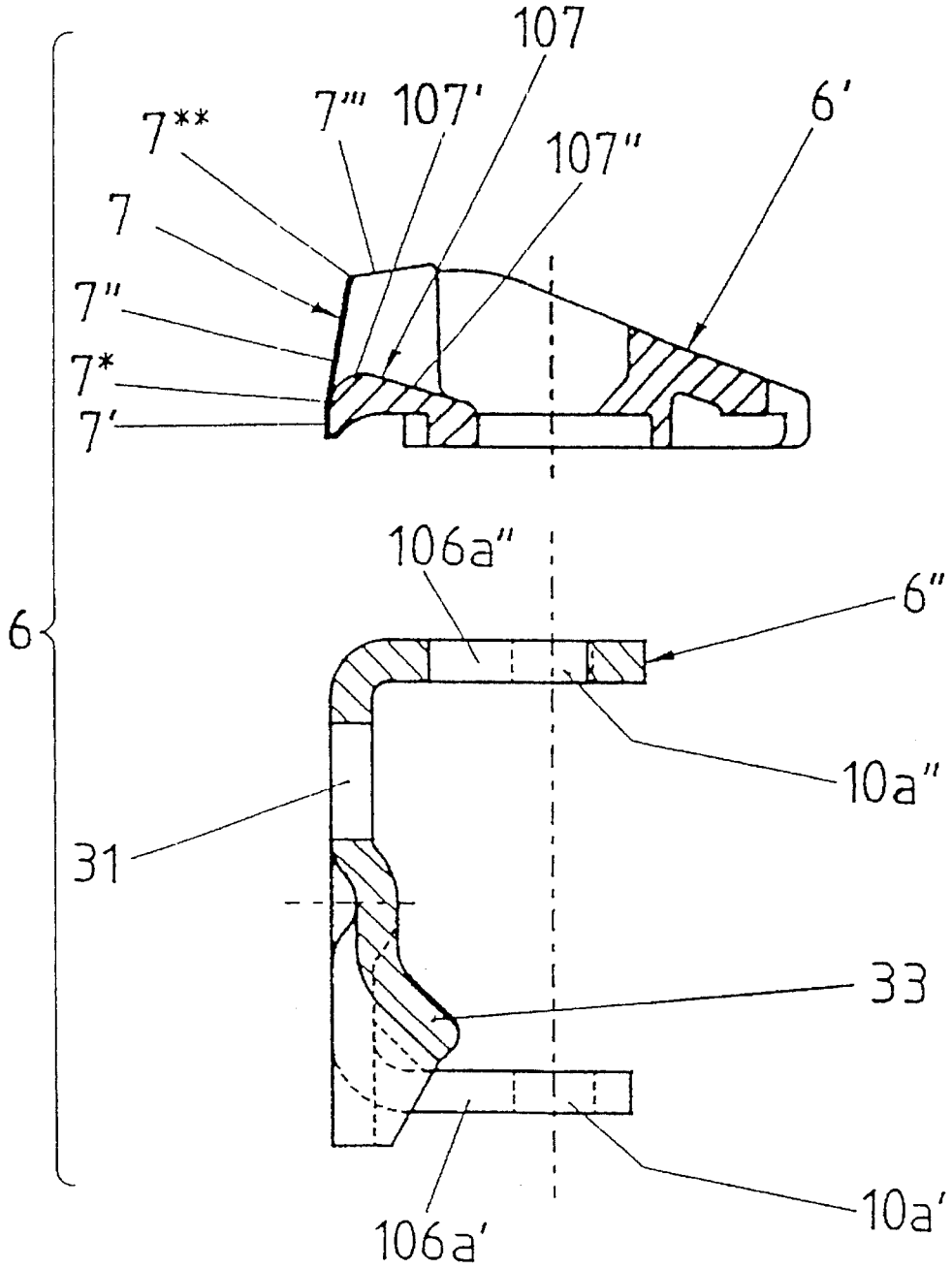
FIG. 3 is a longitudinal cross-sectional view showing a detail side view of the bearing part.

The bearing part 6 separately shown in FIG. 3 consists of an upper partial element 6' and a lower partial element 6", with these partial elements 6', 6" being riveted together in the state of use by means of the support bolts 10*a*, 10*b* for the bent levers 9*a*, 9*b*, so that a form-locking connection results. The bolts 10*a*, 10*b* are, as can be seen in FIGS. 2 and 3, each supported in two bores 10*a'*, 10*a"*, 10*b'*, 10*b"* which are provided one above the other in each of two essentially horizontally extending plates 106*a'*, 106*a"*, 106*b'*, 106*b"* of the lower partial element 6" of the bearing part 6. This lower partial element 6" of the bearing part 6 is furthermore manufactured of a material suitable for this purpose, preferably of steel or of aluminum die cast metal.

The support surface 7 of the bearing part 6 is provided on the front side of the upper partial element 6' and has a lower, essentially vertically oriented partial section 7', a slightly rearwardly inclined partial section 7" thereabove and above same a further, more sharply rearwardly inclined partial section 7'''. The transitions between the essentially flat partial sections 7', 7", 7''' of the support surface 7 are in the form of two edges 7*, 7, with the lowermost partial section 7' transferring through a first edge 7* into the partial section 7" lying thereabove and same through the second edge 7** into the further partial section 7''' lying thereabove, so that during a rolling movement of the bearing part 6 on the crosswall 8 of the housing (for example during a backward release), specifically defined support points 7*, 7**** are created (in the case of a purely backward release this support point is actually a support line, therefore the term "support point" is to also be understood as a "support line" hereinafter). The upper partial element is made of a material which can be easily processed, preferably a plastic, and has already the color intended for the part, which can be viewed from above, so that a separate coloring is no longer needed.

A curved bearing surface 107 is constructed furthermore on this upper partial element 6' of the bearing part 6 on both sides of the central longitudinal plane, by means of which surface the bearing part 6 is supported in the upward direction on a bearing link 108 provided in the housing 1. The bearing link 108 consists of a curved front section 108' and a rearwardly following flat section 108", with the curved section 108' transferring forwardly into the crosswall 8 of the housing. The curved bearing surface 107 is arranged in the direct vicinity of the support surface 7 and consists of a circular section 107' and a straight section 107", which drops off in the rearward direction. The centerpoint of the circular section 107' lies preferably at the same height as the edge 7* of the support surface 7 so that the effect of this edge 7* as a specifically defined support point is enhanced. The section 107" falling off to the rear permits a pivoting movement of the bearing part 6 in an upward direction until this section 107" rests on the flat section 108" of the bearing link 108. From this results, in the nonpivoted state of the bearing part, the condition that the angle between the partial section 7" of the support surface 7 and the vertical is smaller than the angle between the section 107" of the bearing surface 107 and the horizontal, which section 107" drops off to the rear, so that the effect of the second edge 7** as a further specifically defined support point is made possible.

The above-described mechanical construction of the front jaw is suited to permit a lateral, upward and diagonal release of the ski binding. The cooperation of the different mechanical structural parts during a release operation is among others already described in detail in the above-mentioned Patent AT-PS 396 337 and will therefore only be briefly discussed hereinafter.

One of the sole holders 9*a*, 9*b* is pivoted outwardly about the respective bolt 10*a*, 10*b* during a lateral release of the front jaw. The respective inner arm 12*a* or 12*b* of the sole holder is thereby moved rearwardly, thus causing the release plate 25 to be pivoted rearwardly about its pivot axis 26. This pivoting movement is transferred onto the spring-receiving means 15 through the pull piece 28 so that the spring-receiving means slides along the bolt 16 of the adjusting screw 20 rearwardly against the force of the release spring 14 until the ski shoe is laterally released by the loaded sole holder.

The bent levers 9*a*, 9*b* and thus also the bearing part 6 are pivoted upwardly during a rearward release, with the bearing part 6 rolling with its support surface 7 provided on the upper partial element 6' on the housing-fixed crosswall 8. The lever extension 33 of the bearing part 6 engages during this pivoting movement the cam 32 of the release plate 25 and pivots this release plate, as above described, rearwardly against the force of the release spring 14 until the ski shoe is released upwardly by the sole holders.

Such an upward pivoting movement of the bearing part 6 consists of the partial movements discussed in greater detail hereinafter. The first partial section 7' of the support surface 7 rests in the nonpivoted state of the bearing part 6 (FIG. 1) on the crosswall 8 of the housing. During an upward pivoting of the bearing part 6 same is first tilted over the edge 7* provided between the lowermost partial section 7' and the partial section 7" of the support surface 7 oriented thereabove. From this results a definite support point and thus a constant lever arm and the bearing part is pivoted upwardly against an approximately constant spring force until the second section 7" of the support surface 7 rests on the crosswall 8 of the housing. The bearing surface 107 of the upper partial element 6' of the bearing part 6 rolls during this movement at the same time on the bearing link 108 of the housing 1. During a further pivoting movement of the bearing part 6 in upward direction, same is tilted over the edge 7 lying above the edge 7*, thus again determining a definite support point or rather an approximately constant lever arm on the crosswall 8 of the housing. This lever arm is, however, longer than the lever arm determined by the edge 7*, thus causing the release force needed for the further pivoting of the bearing part 6** to assume suddenly a higher value. In the area of this pivoting movement lies the release point of the front jaw during a backward release, which is defined by the sole of the shoe being released upwardly by the sole holders.

Moreover, the inner arms 12*a*, 12*b* of the bent levers 9*a*, 9*b* assume, in such a release mechanism, a certain free floating position so that the bent levers can also be pivoted laterally in an advantageous manner without any additional force.

A mixed load (laterally and upwardly) occurs very often in practice so that the release mechanism consists mostly of components of a lateral and rearward release.

In conclusion, it is stated that the above-described structural details of this invention do, by no means, represent any limitations. For example, the release plate 25 can also be supported in the upper part 2 of the housing and can extend essentially downwardly, or it is also possible to arrange the pull piece below the release spring 14 or laterally thereof.

We claim:

1. A front jaw for a safety ski binding comprising a housing adapted to be fastened to a ski, and two bent levers which have a longer arm and a shorter arm and are pivotal about a generally vertically oriented axis on a bearing part supported for limited movement in said housing, said longer arms of both of said bent levers being disposed outwardly relative to said shorter ams and being designed as sole holders and said shorter arms of both of said bent levers being disposed inwardly relative to said longer arms and engaging a release plate, said release plate being pivotally supported about a generally transversely extending axis on said housing and being biased by a release spring through a connecting element with a forwardly directed pulling force, said release spring being housed in said housing, being supported with a front end thereof in a spring-receiving means, and surrounding a centrally oriented center bolt, wherein said connecting element is a pull piece which engages said spring-receiving means with a front end portion thereof and engages said release plate with a rear end portion thereof to apply said forwardly directed pulling force to said release plate, said spring-receiving means being movable along said center bolt, said center bolt being supported by means of a bolt head engaging at one end thereof a front side of said housing and being connected at another end thereof and through a threaded connection to a spring-support plate, said spring-support plate being biased by said release spring.

2. The front jaw according to claim 1, wherein said release plate is supported pivotally about said transversely extending axis in a lower part of said housing and extends generally vertically upwardly, with said shorter arms of said bent levers engaging an upper area of said release plate on a front side thereof.

3. The front jaw according to claim 1, wherein said pull piece engages said release plate at an upper end of said release plate and extends above said release spring to said spring-receiving means.

4. The front jaw according to claim 1, wherein said pull piece has a plate-shaped configuration and is bent at a front bent end and a rear bent end, said front bent end being supported between said spring-receiving means and said housing and said rear bent end being received in a recess provided at an upper end of said release plate.

5. The front jaw according to claim 1, wherein a pointer is connected to said spring-support plate, which said pointer indicates a set initial tension of said release spring on an indicator disposed on said housing.

6. The front jaw according to claim 1, wherein rearwardly of said release plate there is arranged a stop in the form of an essentially vertical crosswall, which is disposed in a lower part of said housing, an elastic filler piece being inserted between said release plate and said crosswall.

7. The front jaw according to claim 1, wherein said bearing part includes a lever extension, said release plate having a transversely arranged cam facing toward said lever extension on which acts said lever extension during a pivoting movement of said bearing part against the force of said release spring.

8. The front jaw according to claim 1, wherein said bearing part includes an upper partial element and a lower partial element, said upper and lower partial elements being connected form-lockingly with one another in the state of use, with said bent levers being supported on said lower partial element, and said upper partial element having a support surface on a front side thereof, said bearing part being supported by said support surface on said housing.

9. The front Jaw according to claim 8, wherein said support surface has a first, essentially vertical partial section, a second, slightly rearwardly inclined partial section thereabove, and a third, more sharply rearwardly inclined partial section above said second partial section, with said first partial section transferring through a first edge into said second partial section and through a second edge into said third partial section of said support surface.

10. The front jaw according to claim 8, wherein said upper partial element of said bearing part has furthermore a curved bearing surface, through which said bearing part is supported upwardly on a bearing link provided in said housing.

11. The front jaw according to claim 10, wherein said curved bearing surface is disposed near the support surface and, viewed from the side, has a circular section and a straight section dropping off in a rearward direction.

12. The front jaw according to claim 11, wherein a centerpoint of said circular section of said bearing surface lies in the direct vicinity of said second edge between said first and said second partial sections of said support surface substantially at the same height.

13. The front jaw according to claim 8, wherein said upper and said lower partial elements of said bearing part are connected form-lockingly to one another through two bolts extending essentially vertically through said bearing part, each said bent lever being supported on a respective one of said two bolts.

14. The front jaw according to claim 8, wherein said partial elements of said bearing part consists of different materials, with said upper partial element being a plastic and said lower partial element being a die cast metal.

* * * * *